US006082663A

United States Patent [19]

Tramontina et al.

[11] Patent Number: 6,082,663

[45] **Date of Patent: *Jul. 4, 2000**

[54] DISPENSER FOR HORIZONTALLY DISPENSED CENTERFLOW SHEET PRODUCTS

[75] Inventors: Paul F. Tramontina, Alpharetta; Richard P. Lewis, Marietta, both of Ga.

[73] Assignee: Kimberly-Clark Worldwide, Inc., Neenah, Wis.

[ * ] Notice: This patent issued on a continued prosecution application filed under 37 CFR 1.53(d), and is subject to the twenty year patent term provisions of 35 U.S.C. 154(a)(2).

[21] Appl. No.: 09/195,777

[22] Filed: Nov. 18, 1998

[51] Int. Cl.[7] ..... B65H 16/02

[52] U.S. Cl. ..... 242/593; 242/597.5

[58] Field of Search ..... 242/593, 597.5, 242/597.6, 597.8, 597, 613, 613.1, 613.2; 206/409

[56] References Cited

U.S. PATENT DOCUMENTS

| | | | |
|---|---|---|---|
| D. 312,739 | 12/1990 | Sigmund . | |
| D. 324,969 | 3/1992 | Morand . | |
| D. 337,680 | 7/1993 | Giugiaro . | |
| 3,288,388 | 11/1966 | Winkler | 242/613 X |
| 3,523,653 | 8/1970 | Hansen | 242/593 |
| 4,651,895 | 3/1987 | Niske et al. . | |
| 5,065,924 | 11/1991 | Granger . | |
| 5,255,865 | 10/1993 | Buell et al. . | |
| 5,366,175 | 11/1994 | Schutz . | |
| 5,454,500 | 10/1995 | Chen | 242/597.6 X |
| 5,467,893 | 11/1995 | Landis, II et al. . | |
| 5,560,514 | 10/1996 | Frazier . | |
| 5,582,362 | 12/1996 | Johnson et al. . | |
| 5,785,274 | 7/1998 | Johnson . | |

FOREIGN PATENT DOCUMENTS

| | | | |
|---|---|---|---|
| 107487 | 5/1984 | European Pat. Off. | 242/593 |
| 0480848B1 | 1/1994 | European Pat. Off. . | |
| 2645184 | 4/1978 | Germany | 242/597.6 |
| 9322964 | 11/1993 | WIPO . | |
| 9721377 | 6/1997 | WIPO . | |

*Primary Examiner*—Donald P. Walsh
*Assistant Examiner*—William A. Rivera
*Attorney, Agent, or Firm*—Dority & Manning

[57] ABSTRACT

An apparatus which dispenses a static centerflow rolled sheet product. The rolled product is disposed within a housing defined by a front side, back side, and side walls. The front side includes an opening through which an end of the rolled sheet product is pulled. A protrusion is defined, for example, on the back side member and extends towards the front side within the housing. The protrusion is disposed and has a length so as to extend into the rolled sheet product center void a sufficient distance to prevent the rolled product from collapsing on itself as the sheet product is withdrawn.

19 Claims, 2 Drawing Sheets

DISPENSER FOR HORIZONTALLY DISPENSED CENTERFLOW SHEET PRODUCTS

BACKGROUND OF THE INVENTION

Products are available for dispensing centerflow sheet products, for example toilet tissue, paper towels, and the like, in a horizontal mode wherein an end of the sheet product is pulled out from the center of the roll. In other words, the roll does not contain a central core member, but a center space or void that increases in size as the sheet product is pulled from the center of the roll.

A concern with the conventional horizontal dispensing centerflow products is that support must be provided to the outermost layers of the rolled product to prevent collapse of the roll onto itself within the dispenser, thereby causing the product to clump and jam in the dispenser. This concern has been addressed by others in the art. For example, U.S. Pat. No. 5,065,924 discloses a dispenser wherein the roll is retained within a casing or housing purportedly without risk of deformation or collapsing by a device associated with the casing that applies pressure to all or part of the sides of the roll. In one embodiment, the device for applying pressure is a spring loaded back plate that constantly pushes the roll against the forward face or door. U.S. Pat. No. 5,582,362 describes another type of centerflow dispenser wherein a cover engaged with the housing member compresses the paper roll against the base, thereby allegedly preventing sag of the layered paper product as the void in the paper product grows.

There are distinct disadvantages noted with the conventional devices that support centerflow rolled products by compression. For example, the rolled products may vary in width to such a degree that certain roll products cannot be used with the dispensers. The compression device or material or material also tends to wear or loose its effectiveness over time.

The present invention provides an improved centerflow rolled product dispenser that does not rely on a device or mechanism for compressing the roll within the housing.

OBJECTS AND SUMMARY OF THE INVENTION

A principal object of the present invention is therefore to provide an improved centerflow rolled product dispenser.

Additional objects and advantages of the invention will be set forth in part in the following description, or may be obvious from the description, or may be learned through practice of the invention.

In accordance with the invention, an apparatus is provided for dispensing a static centerflow rolled sheet product wherein an end of the rolled sheet product is withdrawn from a center space or void. As is commonly understood, this center space or void expands or "grows" as more of the rolled sheet product is withdrawn. The apparatus includes a housing having a front side, a back side, and a side wall disposed between the front and back sides. The housing defines an internal space having a size so as to accommodate the rolled sheet product. The internal space is preferably substantially cylindrical to match the shape of the rolled sheet product and has a width at least equal to that of the rolled sheet product so that the product is disposed within the housing in a non-compressed state between the front and back sides.

The front side is preferably removably attached to the housing to provide easy access to the internal space for loading the rolled sheet product.

An opening is disposed through the front side so that the end of the rolled sheet product can be withdrawn through the front side. In one preferred embodiment, this opening is defined by a flexible membrane with slits disposed therethrough that further define flexible members through which the sheet product is pulled. The flexible members impart a degree of retaining tension or friction to the sheet product that allows the sheet product to be easily separated at perforation lines defined in the product. In other words, the flexible members retain the sheet product to a degree necessary so that a quick pull or tug will cause the rolled product to separate along the perforations without pulling additional unwanted lengths of the rolled sheet product out of the dispenser.

A protrusion is disposed within the internal space of the housing. For example, the protrusion may be defined on the back side of the housing and extend towards the front side within the internal space. This protrusion is disposed and has a length so as to extend at least about halfway into the rolled sheet product center void to prevent the rolled sheet product from collapsing on itself as the product is withdrawn and the center void grows. In a preferred embodiment, this protrusion has a length so as to extend substantially to the end or through the rolled sheet product. Thus, as the center void of the rolled product grows and the upper layers tend to fall towards the bottom layers, the protrusion prevents the upper layers from collapsing onto the bottom layers, thus allowing for continued withdrawal of the rolled product without binding or jamming of the product within the dispenser.

In one preferred embodiment, the protrusion includes a recess defined along at least a portion of the upper surface thereof. For example, this recess may be defined by an upwardly disposed concave section. This recess or concave section provides a space for the upper layers of the roll to fall into as the center void grows and thus acts as a retaining device or structure to seat or retain the upper layers on the protrusion. In an alternative embodiment, this recess may also be formed by rib members that define, for example, an X-shaped cross-sectional profile.

It should be appreciated that, with the dispenser according to the invention, the back wall or side of the dispenser may be static or fixed in position so that it need not apply a compressive force against the rolled product. In this embodiment, the length of the protrusion should be sufficient to prevent the rolled sheet product from collapsing on itself as the product is withdrawn from the dispenser. For example, it may be preferred that the protrusion extend from at least about halfway through the rolled product or further. However, it is within the scope of the invention that the protrusion extend less than halfway so long as the length of the protrusion is sufficient to prevent the upper layers of the roll from collapsing onto the bottom layers.

The invention will be described in greater detail below through use of the figures.

DETAILED DESCRIPTION

Reference will now be made in detail to the presently preferred embodiments of the invention, one or more examples of which are illustrated in the figures. Each example is provided by way of explanation of the invention, and is not meant as a limitation of the invention. For example, features illustrated or described as part of one embodiment can be used with another embodiment to yield still a further embodiment. It is intended that the present invention include such modifications and variations as come within the scope and spirit of the invention.

Figure 1:
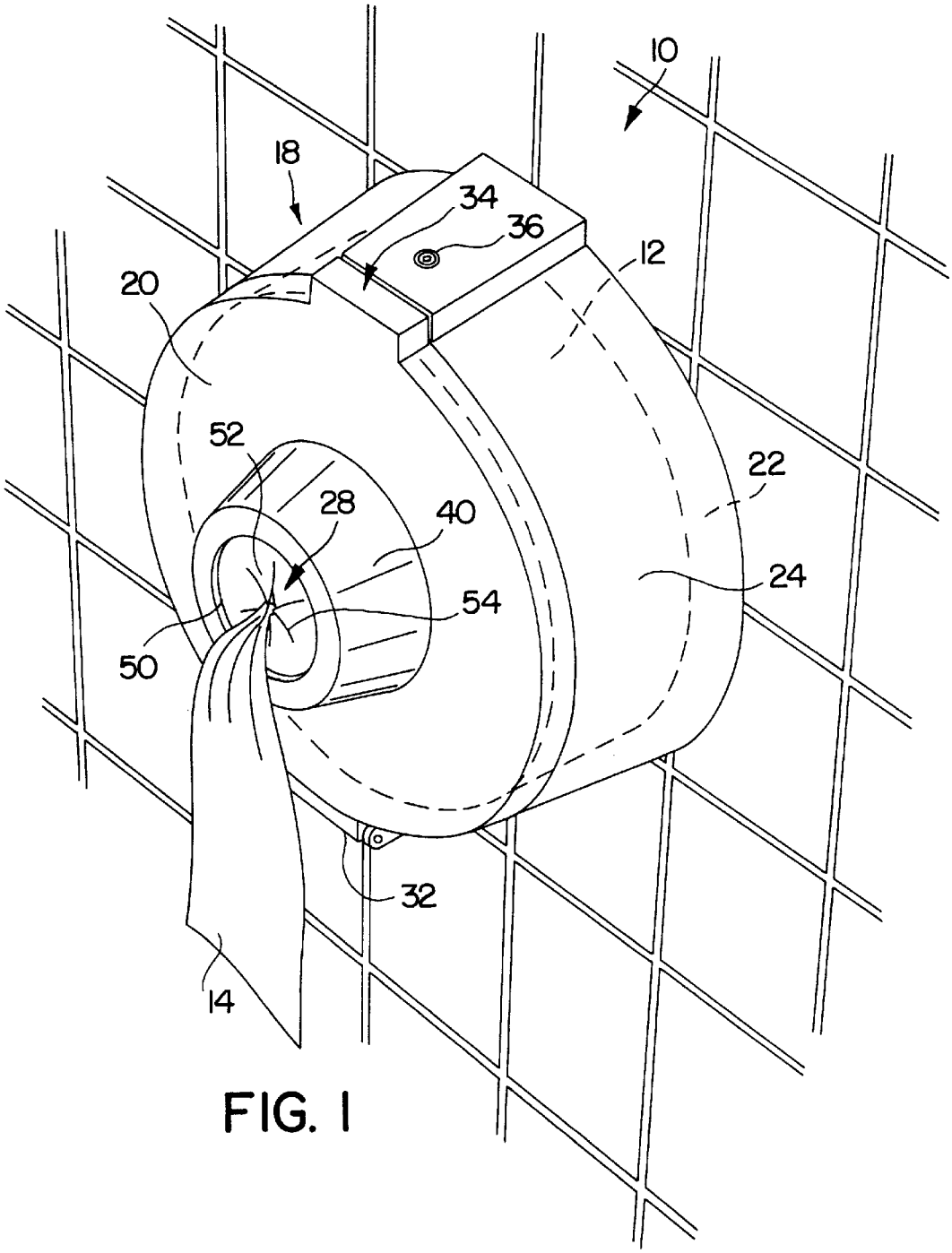
FIG. 1 is a perspective view of the dispenser according to the invention mounted on a wall.

Referring to FIG. 1 in general, dispensing apparatus 10 according to the invention is illustrated mounted on a wall. Any conventional means, such as adhesives, and the like, can be used to mount apparatus 10 onto any wall or surface structure.

Apparatus 10 includes a housing, generally 18, that encloses a centerflow rolled sheet product 12. The invention is applicable to any type of centerflow rolled sheet product. Housing 18 can have any shape or configuration and defines an internal space or volume 26 for accommodating rolled product 12. Housing 18 is defined by a front side member 20, a back side member 22, and a side wall 24. Side wall 24 preferably has a width at least equal to that of rolled product 12 so that the rolled product is contained within housing 18 in a non-compressed state. It should be appreciated, however, that this condition is not a requirement of the invention, and that it is within the scope of the invention to include a device for applying a compressive force to rolled product 12.

Side wall member 24 also includes ribs 48 defined along the bottom portion thereof. Ribs 48 serve to support the bottom outermost layers of rolled product 12 within housing 18.

Front side 20 essentially defines a cover component for housing 18 and is attached to side wall 24 by any conventional hinge mechanism, such as mechanism 32 illustrated in the figures. Any conventional latch device, such as latch 34 illustrated in the figures, is used to secure front side 20 relative to housing 18. Any conventional locking device, such as the rotatable lock 36 illustrated in the figures, may be used to lock front side 20 relative to housing 18. It is well within the level of skill of those in the art to configure any conventional hinge mechanism, latch mechanism, or lock device for use in the present invention.

Front side 20 also defines an opening, generally 28, through which end 14 of the rolled product 12 is pulled, as particularly illustrated in FIG. 1. In a preferred embodiment as illustrated in FIG. 1, opening 28 is defined in a forwardly projecting recess defined by a protrusion member 40 disposed on the outer surface of front side 20. A flexible membrane member 50 is disposed across the open end of protrusion member 40 and includes flexible members 52 defined by slits 54. As illustrated in FIG. 1, the rolled product is pulled through flexible members 52 wherein flexible members 52 impart a retaining frictional force to the rolled product. In this regard, the sheet product can be separated along perforation lines formed therein with an easy tug or pull on the end 14. Flexible members 52 provide enough of a retaining force on the sheet product so that additional lengths of the product are not pulled from the dispenser when trying to separate or tear the product along the perforation lines. Flexible members 52 and membrane 50 also provide a seal to prevent foreign matter, moisture, etc., from entering into the apparatus.

A protrusion, generally illustrated as 30, is disposed within volume 26 and may be defined on back side 22 and extend towards front side 20. Protrusion 30 is positioned so as to extend into center void 16 of rolled product 12. Protrusion 30 has an axial length so as to extend into rolled product 12 a sufficient distance to prevent the upper layers of rolled product 12 from collapsing onto the bottom layers as center space or void 16 grows. In a preferred embodiment, protrusion 30 extends at least halfway through rolled product 12 and, preferably, substantially to the end or completely through rolled product 12. However, it is within the scope of the invention that protrusion 30 extend less than halfway through rolled product 12 so long as its axial length is sufficient to prevent the upper layers of the product from collapsing onto the lower layers.

Figure 2A:
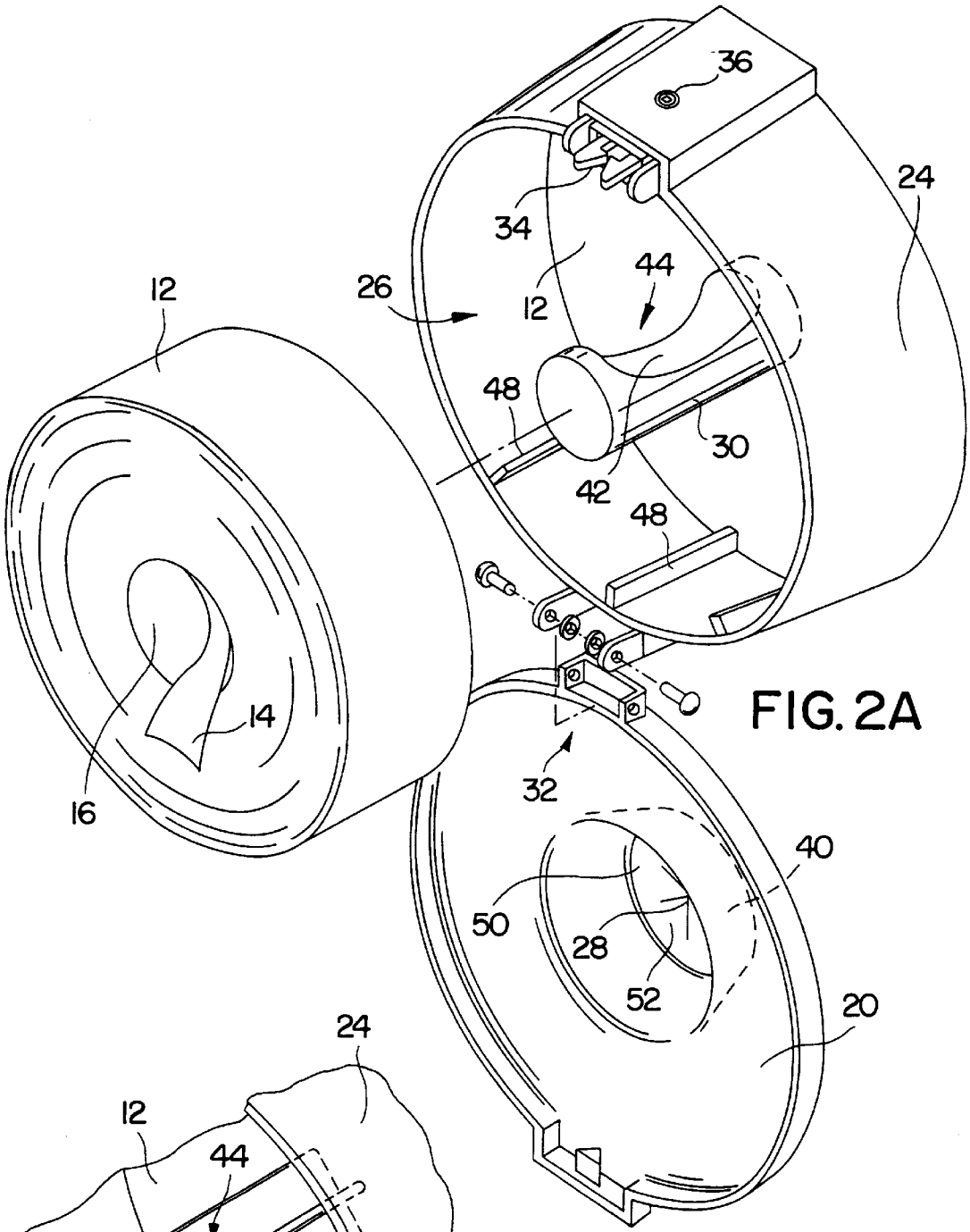
FIG. 2*a* is an exploded component view of the dispenser according to the invention.
Figure 2B:
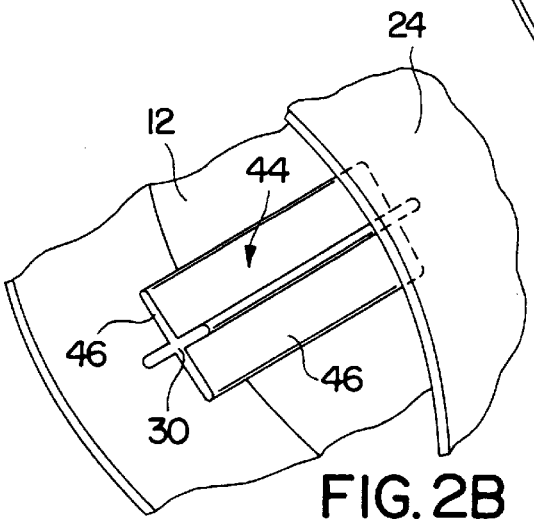
FIG. 2*b* is an enlarged perspective view of an alternative embodiment of the protrusion according to the invention.

Protrusion 30 can take on any configuration or shape, including the substantially cylindrical shape illustrated in FIG. 2*a* and the X-shaped profile shown in FIG. 2*b*.

It may be preferred that protrusion 30 also include a recessed portion, generally 44, disposed on the upper side thereof along at least a portion of the length of protrusion 30. In the embodiment illustrated in FIG. 2*a*, recessed portion 44 is defined by a generally concave portion 42. In the embodiment illustrated in FIG. 2*b*, recessed portion 44 is defined between the crossed ribs 46 that further define the X-shaped profile of protrusion 30. The recessed portion defines a space or region into which the upper layers of rolled product 12 fall as center void or space 16 grows with use of the rolled product. Recessed portion 44 tends to retain the upper layers on protrusion 30 in a generally flat or non-bunched manner as more of the rolled product 12 is pulled from the apparatus. Thus, the upper layers are prevented from bunching or being pulled towards front side 20 which might lead to jamming of the rolled product or a separation of the rolled product within apparatus 10.

It should be appreciated that, although the present invention is described and illustrated herein with a static back wall or member 22, the invention is just as applicable in a dispensing apparatus wherein the back wall is spring loaded or otherwise biased towards the front side to apply a compressive force to rolled product 12. In an alternative embodiment, a separate biasing device may also be incorporated within internal space 26. In other words, the present invention has application beyond a dispenser having a static back wall.

It is also within the scope of the invention for protrusion 30 to be axially adjustable with volume 26. For example, protrusion 30 may comprise a telescoping structure, or other adjustable structure.

It should be appreciated by those skilled in the art that various modifications and variations can be made in the present invention without departing from the scope and spirit of the invention. For example, protrusion 30 can take on any shape or configuration and need only have a length sufficient to prevent the upper layers of the rolled product from collapsing onto the lower layers. All such variations and modifications are within the scope of the invention.

What is claimed is:

1. An apparatus for dispensing a static centerflow rolled sheet product wherein an end of the rolled sheet product is withdrawn from a center void that expands as more of the rolled sheet product is withdrawn, said apparatus comprising:

a housing, said housing including a front side, back side, and a side wall disposed between said front and back sides, said housing defining an internal space having a size so as to accommodate the rolled sheet product;

said front side further comprising an opening therethrough disposed so that the end of the rolled sheet product can be withdrawn through said front side; and a generally horizontal protrusion disposed within said internal space, said protrusion having a length so as to extend at least about half-way into the rolled sheet product center void to support and prevent collapsing upper layers of the rolled sheet product from collapsing onto bottom layers of the rolled sheet product as the rolled sheet product is withdrawn, said protrusion further comprising a longitudinally extending upwardly oriented recess defined along at least a portion of an uppermost surface thereof, said recess providing a region into which upper layers of the rolled sheet product fall as a void in the rolled sheet product grows as the rolled sheet product is withdrawn.

2. The apparatus as in claim 1, wherein said protrusion has a length so as to extend substantially to the end of or through the rolled sheet product.

3. The apparatus as in claim 1, wherein said internal space of said housing is substantially cylindrical.

4. The apparatus as in claim 1, wherein said side wall has a width at least equal to that of the rolled sheet product so that the rolled sheet product is disposed within said housing in non-compressed state between said front and back sides.

5. The apparatus as in claim 1, wherein said front side is removably attached to said housing to provide access to said internal space for loading the rolled sheet product.

6. The apparatus as in claim 1, wherein said protrusion comprises a substantially constant cross-sectional shape along generally the length thereof.

7. The apparatus as in claim 6, wherein said protrusion comprises one of a generally cylindrical shape.

8. The apparatus as in claim 6, wherein said protrusion comprises one of a generally X-shaped cross-sectional shape.

9. The apparatus as in claim 1, wherein said protrusion comprises a cross-sectional shape that varies along generally the length thereof.

10. The apparatus as in claim 1, wherein said opening further comprises flexible members disposed thereacross through which the rolled sheet product passes.

11. The apparatus as in claim 10, wherein said flexible members are defined by a slit flexible membrane.

12. An apparatus for dispensing a static centerflow rolled sheet product wherein an end of the rolled sheet product is withdrawn from a center void that expands as more of the rolled sheet product is withdrawn, said apparatus comprising:

a housing, said housing including a front side, back side, and a side wall disposed between said front and back sides, said housing defining an internal space having a size so as to accommodate the rolled sheet product;

said front side further comprising an opening therethrough disposed so that the end of the rolled sheet product can be withdrawn through said front side; and a protrusion disposed within said internal space, said protrusion having a length so as to extend into the rolled sheet product center void a sufficient distance to prevent the rolled sheet product from collapsing on itself as the rolled sheet product is withdrawn;

wherein said protrusion is generally cylindrical with a cross-sectional shape that varies generally along its length and with a longitudinally extending concave section defined therein.

13. The apparatus as in claim 12, wherein said concave sections is disposed upwards so that the rolled sheet product eventually collapses into said concave section.

14. An apparatus for dispensing a static centerflow rolled sheet product wherein an end of the rolled sheet product is withdrawn from a center void that expands as more of the rolled sheet product is withdrawn, said apparatus comprising:

a housing, said housing including a front side, a static back side, and a side wall disposed between said front and back sides, said housing defining an internal space having a size so as to accommodate the rolled sheet product;

said front side further comprising an opening therethrough disposed so that the end of the rolled sheet product can be withdrawn through said cover; and a protrusion extending from said back side towards said front side within said internal space, said protrusion disposed and having a length so as to extend into the rolled sheet product center void a sufficient distance to prevent upper layers of the rolled sheet product from collapsing longitudinally into the center void onto bottom layers of the rolled sheet product as the rolled sheet product is withdrawn, said protrusion further comprising a longitudinally extending and upwardly oriented recess defined along at least a portion of an uppermost surface thereof, said recess providing a region into which upper layers of the rolled sheet product fall as a the center void grows.

15. The apparatus as in claim 14, wherein said protrusion has a length so as to extend at least halfway through the rolled sheet product center void.

16. The apparatus as in claim 14, wherein said protrusion has a length so as to extend substantially through the rolled sheet product center void.

17. The apparatus as in claim 14, wherein said side wall has a width at least equal to that of the rolled sheet product wherein the rolled sheet product is disposed within said housing in non-compressed state between said front and back sides.

18. The apparatus as in claim 14 wherein said front side is removably attached to said housing to provide access to said internal space for loading the rolled sheet product.

19. The apparatus as in claim 14, wherein said opening further comprises flexible members disposed thereacross through which the rolled sheet product passes.

* * * * *